United States Patent [19]

Cappello

[11] 4,040,516

[45] Aug. 9, 1977

[54] SAFETY MATCH PACKET

[76] Inventor: Anthony S. Cappello, 4017 Everett Ave., Oakland, Calif. 94602

[21] Appl. No.: 597,399

[22] Filed: July 18, 1975

[51] Int. Cl.[2] ..... A24F 27/12; A24F 27/00

[52] U.S. Cl. ..... 206/109

[58] Field of Search ..... 206/109, 106, 108, 100

[56] References Cited

U.S. PATENT DOCUMENTS

| | | | |
|---|---|---|---|
| 2,217,854 | 10/1940 | Baldwin | 206/109 |
| 2,369,884 | 2/1945 | De Lauder | 206/109 |
| 2,935,184 | 5/1960 | Olson | 206/109 |
| 3,966,041 | 6/1976 | Burgess et al. | 206/108 |
| 3,967,725 | 7/1976 | Thompson | 206/108 |

*Primary Examiner*—William T. Dixson, Jr.
*Attorney, Agent, or Firm*—William R. Piper

[57] ABSTRACT

A safety match packet in which the front and back covers that enclose the comb of safety matches are formed from a single sheet of material. In addition, the sheet of material has a double folded end that receives the base of the safety match comb and the double fold forms a transversely extending pocket that is open at both ends and has at least one of its inner surfaces lined with a safety match igniting material. A safety match may be removed from the comb of matches and, after the front cover is closed, the match head may be inserted into the pocket from either end and then with a sufficient compressive pressure applied by the thumb and fingers of one hand on the outer walls of the pocket and a quick outward pull on the end of the match with the other hand, the safety match will be ignited without any chance of the person burning the fingers or face.

1 Claim, 4 Drawing Figures

SAFETY MATCH PACKET

SUMMARY OF THE INVENTION

An object of my invention is to provide a safety match packet which includes a transversely extending pocket lined with safety match igniting material. A safety match may be removed from the comb of matches and the match head inserted into the pocket from either end for the purpose of lighting it and the pocket will prevent any flash-back that might burn the hands or face. The lighting of the match is readily accomplished by the operator compressing the opposite sides of the pocket with one hand and with sufficient pressure and then a quick pull on the exposed end of the safety match with the other hand will cause it to ignite as the match head is moved across the igniting surface. The pocket is open at both ends and this permits either a right-handed person or a left-handed person to use the safety match packet because the right-handed person would insert the match head from one end of the pocket for igniting it while the left-handed person could insert the match head from the opposite end of the pocket.

DESCRIPTION OF THE PREFERRED EMBODIMENT

Figure 4:
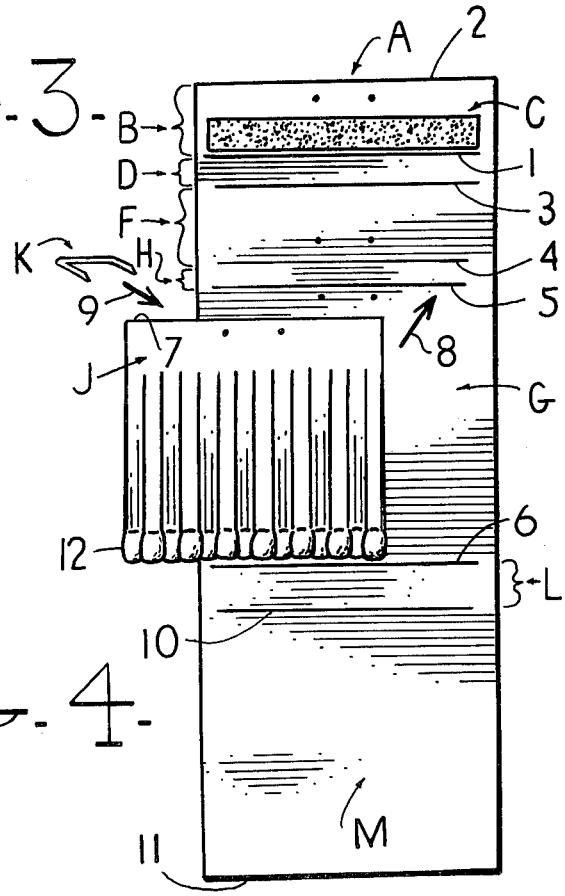
FIG. 4 is an exploded view of a development of the piece of material used for forming the back and front covers of the safety match packet as well as the transversely extending pocket. The Figure further shows a comb of safety matches ready to be applied to the piece of material by staple.

In carrying out my invention I provide a rectangular sheet, indicated generally at A in FIG. 4, and it can be made of any material desired, such as cardboard of a light weight. The sheet has a number of transversely extending and parallely arranged fold lines and the sheet is folded along these lines to form the different parts of the safety match packet. The fold line 1 is spaced from the end 2 of the rectangular piece A and the portion B lying between these two has a strip C of safety match igniting material secured thereto.

Figure 1:
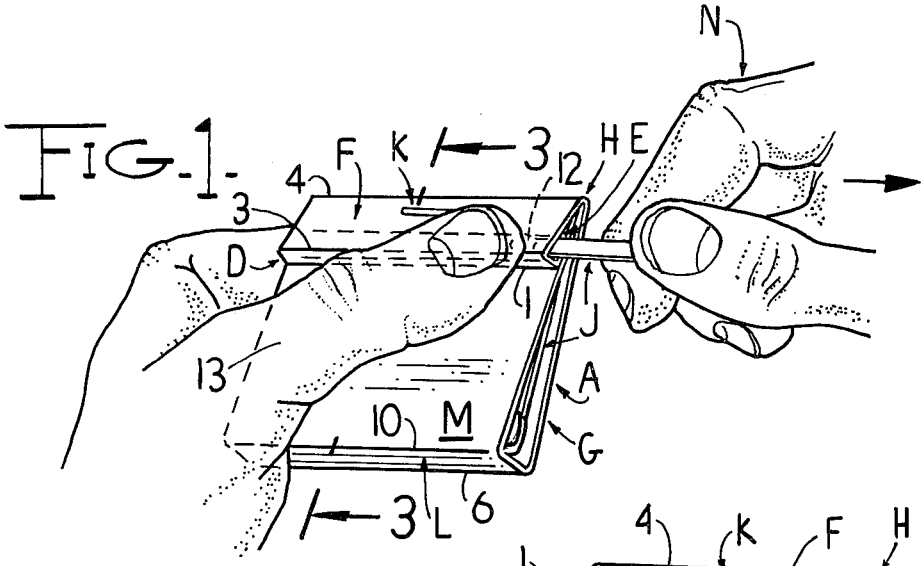
FIG. 1 is a perspective view of my improved safety match packet and illustrates how the device is used during the igniting of a match.
Figure 2:
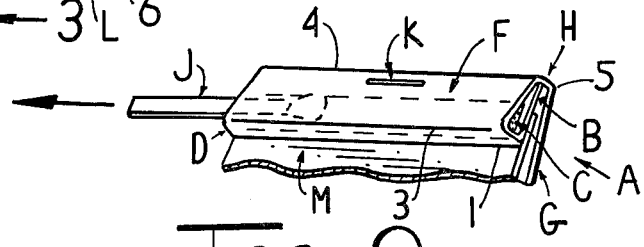
FIG. 2 is a fragmentary perspective view showing how the opposite open end of the transversely extending pocket can be used by a left-handed person when igniting a match.
Figure 3:
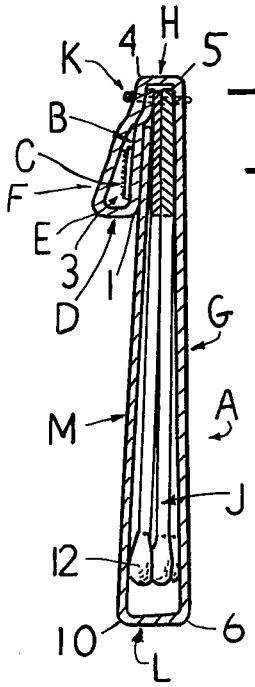
FIG. 3 is a section taken along the line 3—3 of FIG. 1, and illustrates how the comb of matches is protected from the pocket that can receive individual safety matches for igniting them.

Another fold line 3 parallels the fold line 1, see FIG. 4, and is spaced a short distance from it to provide a portion D that forms a wall for a pocket E which extends substantially at right angles to the portion or wall B when the pocket is completely formed, see also FIGS. 1, 2 and 3. Another fold line 4 is indicated in FIG. 4 and this line is spaced substantially the same distance from the fold line 3 as the line 1 is spaced from the end 2 of the material A. The portion F lying between the parallel fold lines 3 and 4 forms a front wall that is spaced from the rear wall B when the pocket E is formed. This affords sufficient space between the two walls B and F to permit the insertion of a safety match from either end of the pocket preparatory to igniting the match head.

The back cover G lies between the fold lines 5 and 6 on the rectangular piece A, as shown in FIG. 4. The fold line 5 is spaced a short distance from the fold line 4 to form a base portion H wide enough to accommodate the thickness of a standard comb of safety matches J. When the rectangular piece A is folded along the lines 1, 3, 4 and 5 to form the pocket E and to receive the comb of safety matches J, the lower edge 7 of the comb of matches will bear against the base H and then a single staple K is driven through the front wall F and the rear wall B of the pocket and also through the base of the comb of safety matches J, and through the back G, as shown in FIG. 3, and as indicated by the pairs of holes in the piece A. In this way a single staple is the only fastening means necessary to complete the formation of the safety match packet. In FIG. 4 the comb of safety matches J is shown slightly removed from the rectangular piece A so that the fold lines will show. An arrow 8 in FIG. 4 illustrates the direction of movement where the staple K will enter the safety match comb for securing it to the packet.

The final fold line 10 is spaced from and parallels the fold line 6 so as to provide a top portion L for the packet, see FIGS. 1, 3 and 4. The cover M for the packet lies between the fold line 10 and the edge 11 of the rectangular piece A. This completes the structure of the device. The length of the cover M is such that the outer edge 11 can be slipped between the rear wall B of the pocket E and the front surface of the safety match comb J.

OPERATION

From the foregoing description of the various parts of the device, the operation thereof may be readily understood. The safety match packet is in normally closed position, as shown in FIGS. 1 and 3. When a person desires to use one of the safety matches J, the cover M is opened and a safety match removed from the comb J after which the cover is closed. Assume that a right-handed person is going to ignite the match head 12, the closed safety match packet is held in the left hand and the right hand is used for inserting the safety match J into the right hand end of the pocket E, head first, as is clearly shown in FIG. 1.

The thumb 13 of the left hand now presses down upon the front wall F of the pocket at the place where the match head 12 underlies the front wall. The other portion of the left hand underlies the back cover G of the packet. A slight pressure must now be applied by the thumb against the front wall F of the pocket to move the match head 12 against the match igniting strip C. This is done while the right hand gives a quick outward pull on the safety match J so that the match head 12 will scrape across the strip C and be ignited. It should be noted that if the left hand thumb 13 exerts too much pressure against the front wall F of the pocket E, and therefore too much pressure against the match head 12, the match J cannot be pulled out from the pocket. On the other hand, if too little pressure is exerted by the thumb 13, the matchhead 12 will not ignite as the match is pulled from the pocket.

What I have described as to how to use the safety match packet by a right-handed person in igniting a safety match J, the same can be said for a left-handed person, see FIG. 2, except that now the packet is held in the right hand and the match is held by the left hand.

The simplicity of the design of my safety match packet will cause very little change to be made in the manufacture of the packet from the procedure followed presently.

The particular structure of the match igniting strip C being concealed within the pocket E has a threefold purpose relating to safety. 1. The person in using the device must insert the match head 12 into the pocket from either open end and then pull the match J away from the main packet of matches during the igniting of the match. This will insure that no flash-back can occur which might ignite the remaining matches in the pack still being held in the hand. 2. No burning sulphur sparks can be thrown into the eyes of the person using the safety packet. 3. The person using the device must have sufficient manual dexterity to apply the necessary pressure against the match head and also have sufficient sequence of motions to at the same time pull the match from the pocket at the proper speed to ignite the match. This would be impossible for a child to accomplish because a person would have to at least reach an age where a certain amount of reasoning would be necessary to ignite the match. A child could not do this and so the device provides a child-resistant package making it impossible for a child to ignite one of the matches.

I claim :

1. A safety match packet comprising:

a. a semi-flexible rectangular sheet folded upon itself to form an interconnected front and back cover to house a comb of safety matches and enclose the heads of the safety match comb;

b. said rectangular sheet having an additional length extending beyond said back cover to be folded into a safety match receiving pocket that is open at both ends in order to readily receive a match head and has an unobstructed length coextensive with the width of the rectangular sheet;

c. the pocket having an outer wall spaced from an inner wall of the pocket by a spacing wall whose plane extends substantially at right angles to the planes of said outer and inner walls of said pocket, the end of the inner pocket wall contacting the adjacent portion of the outer pocket wall to constitute a closure for the pocket that parallels the plane of said spacing wall and extending through the length of the pocket;

d. a safety match igniting strip secured to one of the inner surfaces of the pocket outer or innerwall and having a length substantially equal to the length of the pocket; and e. a fastening member positioned substantially midway between the open ends of the pocket and extending through both the outer and inner walls of the pocket also through the base of the comb of safety matches and through said back cover for securing them together and for positively separating the pocket interior from the comb of safety matches, said fastening member not obstructing a clear passage along the pocket from one end of the pocket to the other open end;

f. the lateral interior spacing between the outer and inner walls of the pocket being substantially the same throughout the length of the pocket to loosely receive the head and part of the shank of a safety match whether the match is inserted from either open end of the pocket, whereby lateral inward pressure is required to be applied against the outer wall of the pocket and against said back cover for forcing said outer pocket wall against the match head for forcing the latter against said match igniting strip so that an outward pull of the exposed shank of the match will cause the head to frictionally engage with the igniting strip to ignite the match head while it is still within the pocket so that the pocket will prevent any undue flaring of the match head material from striking the person using the match pocket and also from contacting with the comb of safety matches.

* * * * *